US006955495B1

(12) United States Patent
Datta et al.

(10) Patent No.: US 6,955,495 B1
(45) Date of Patent: Oct. 18, 2005

(54) RETRACTABLE DELIMITERS FOR RUNWAYS, ROADS AND THE LIKE

(76) Inventors: Calvin Datta, HC 60 Box 245, Copper Center, AK (US) 99573; Jennifer Datta, HC Box 245, Copper Center, AK (US) 99573

( * ) Notice: Subject to any disclaimer, the term of this patent is extended or adjusted under 35 U.S.C. 154(b) by 131 days.

(21) Appl. No.: 10/238,226

(22) Filed: Sep. 10, 2002

(51) Int. Cl.[7] ..... E01F 9/018; E01F 9/019

(52) U.S. Cl. ..... 404/10; 404/11; 404/9; 49/49

(58) Field of Search ..... 404/9, 10, 11, 6; 49/49

(56) References Cited

U.S. PATENT DOCUMENTS

| | | | | | |
|---|---|---|---|---|---|
| 3,628,296 | A | * | 12/1971 | Henry | 52/98 |
| 3,660,935 | A | * | 5/1972 | Boots | 49/35 |
| 3,956,853 | A | * | 5/1976 | Montgomery | 49/35 |
| 4,522,530 | A | * | 6/1985 | Arthur | 404/10 |
| 4,666,331 | A | * | 5/1987 | Riley | 404/6 |
| 4,919,563 | A | * | 4/1990 | Stice | 404/6 |
| 5,070,646 | A | * | 12/1991 | Colombo | 49/49 |
| 5,214,886 | A | * | 6/1993 | Hugron | 52/98 |
| 5,425,595 | A | * | 6/1995 | Roper | 404/9 |
| 5,441,359 | A | * | 8/1995 | Filippi | 404/6 |
| 5,462,384 | A | * | 10/1995 | Arlandis | 404/6 |
| 5,469,936 | A | * | 11/1995 | Lauga et al. | 187/205 |
| 5,476,338 | A | * | 12/1995 | Alberts | 404/6 |
| 5,819,471 | A | * | 10/1998 | Koerber | 49/49 |
| 5,975,792 | A | * | 11/1999 | Goeken et al. | 404/6 |
| 6,099,200 | A | * | 8/2000 | Pepe et al. | 404/6 |
| 6,113,055 | A | * | 9/2000 | Salman | 248/548 |
| 6,494,636 | B1 | * | 12/2002 | Mozena | 403/109.2 |
| 6,516,573 | B1 | * | 2/2003 | Farrell et al. | 52/98 |
| 2002/0090259 | A1 | * | 7/2002 | Crowley et al. | 404/6 |

FOREIGN PATENT DOCUMENTS

| | | | | |
|---|---|---|---|---|
| EP | 492024 B | * | 12/1990 | E01F 13/00 |
| FR | 2687702 A1 | * | 8/1993 | E01F 13/00 |

* cited by examiner

*Primary Examiner*—Robert E. Pezzuto
*Assistant Examiner*—Alexandra Pechhold
(74) *Attorney, Agent, or Firm*—Michael Tavella

(57) ABSTRACT

A delimiter that can be arranged along the sides of a runway. The delimiter can be locked in an upright position for most normal operations. When the runway must be cleared of snow, an operator can lower the delimiters in place, either manually or by motor. After the runway has been cleared of snow, the delimiters can be raised again for use. Unlike the delimiters described above, these delimiters meet all aircraft regulation requirements. When collapsed, they do not protrude above the surface of the ground. The delimiters also have a shear mechanism that allows the raised portion of the delimiter to break off when struck. This shear mechanism protects aircraft by breaking away the upper portion of the delimiter.

17 Claims, 5 Drawing Sheets

RETRACTABLE DELIMITERS FOR RUNWAYS, ROADS AND THE LIKE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to delimiters and particularly to retractable delimiters.

2. Description of the Prior Art

Rural airports do not generally have the types of facilities used at major airports. For example, many of these airports do not have runway lighting. The runways are marked by delimiters—cones that are placed at regular intervals along the sides of the runway. These cones are visible to pilots and enable them to see the edges of the runway. When the runway needs maintenance, e.g., when snow must be removed, the delimiters become obstacles to the cleaning process. Thus, a crew must physically remove the cones before the runway can be plowed. This may mean having a worker walk the length of the runway to move the cones. Once the snow is cleared, the cones have to be replaced. This also requires time and labor to perform.

To eliminate the need to remove cones or other delimiters, several retractable types of delimiters have been invented. These delimiters can be retracted into the ground when they are not needed and then raised when they are needed. Many of the patents for these types of delimiters are directed to highway and parking lot use. For example, large arena parking lots often need to set cones for traffic flow into the parking lot. Use of the retractable delimiters allows the parking crew to raise those units as needed to create the proper traffic flow. As time progresses and the traffic flow must be adjusted, delimiters can be raised and lowered as needed Examples of these devices are found in the following U.S. Pat. Nos. 364,175, 3,086,430, 5,425,595 and 5,819,471.

One problem with all of these designs is that they are unsuitable for use at airports. Under aviation rules, any delimiter must collapse when struck be a wing. A freestanding cone presents no danger to an airplane. However, a rigidly installed retractable delimiter does present such a danger. These devices are not designed to flex or break when hit and can therefore cause serious damage to an airplane.

BRIEF DESCRIPTION OF THE INVENTION

The instant invention overcomes these difficulties. It is a delimiter that can be arranged along the sides of a runway. The delimiters can be locked in an upright position for most normal operations. When the runway must be cleared of snow, an operator can lower the delimiters in place, either manually or by motor. After the runway has been cleared of snow, the delimiters can be raised again for use. Unlike the delimiters described above, these delimiters meet all aircraft regulation requirements. When collapsed, they do not protrude above the surface of the ground. The delimiters also have a shear mechanism that allows the raised portion of the delimiter to break off when struck. This shear mechanism protects aircraft by breaking away the upper portion of the delimiter.

It is an object of this invention to produce a delimiter for use at airports that can be raised and lowered quickly and easily.

It is a further object of this invention to produce a delimiter that has a breakaway capability to protect aircraft and vehicles that contact the delimiter.

It is yet a further object of the invention to produce a delimiter that can be raised and lowered by a motor.

DETAILED DESCRIPTION OF THE INVENTION

Figure 1:
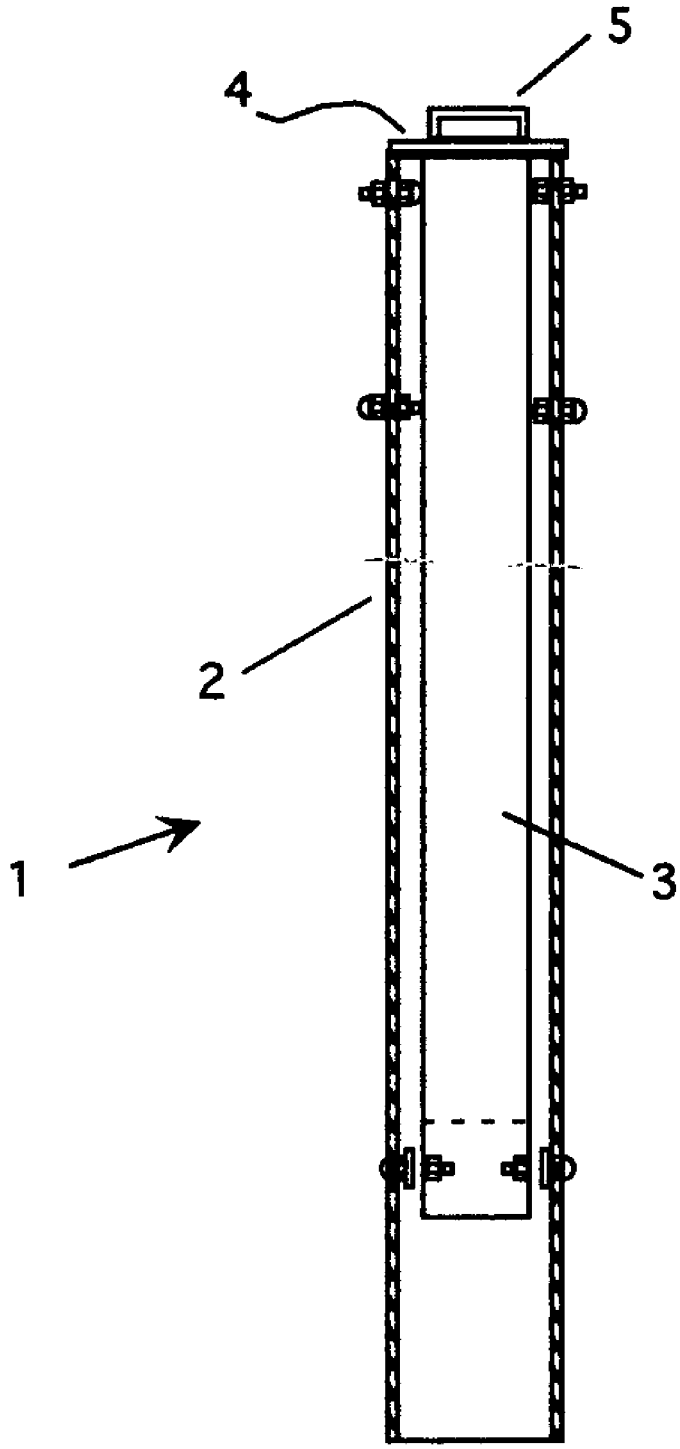
FIG. 1 is a cross-sectional view of the manually operated delimiter in the retracted position.
Figure 2:
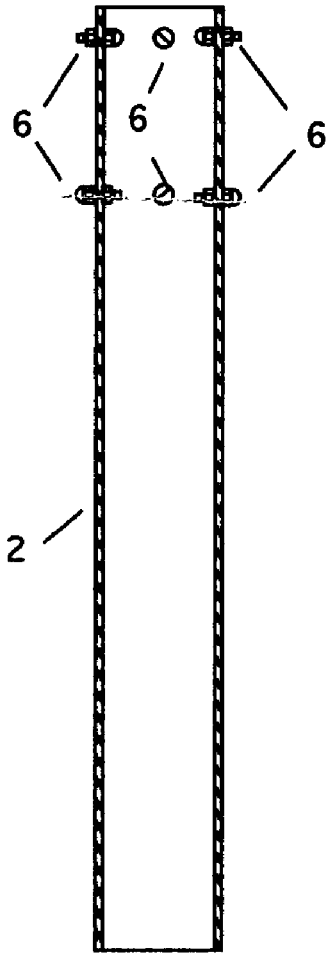
FIG. 2 is a cross-sectional view of the outer tube of the manually operated delimiter.
Figure 3:
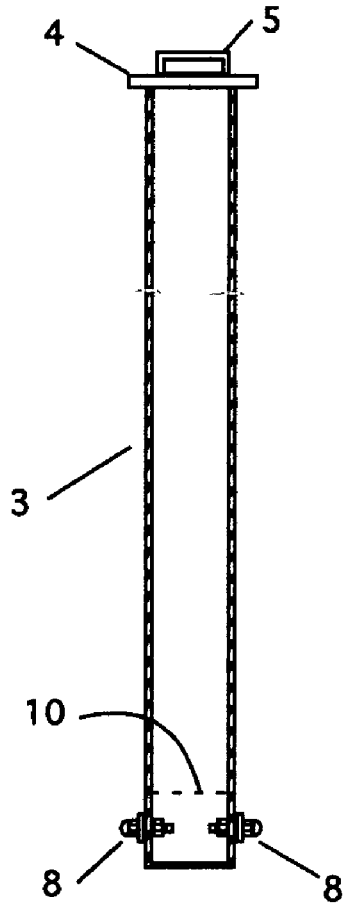
FIG. 3 is cross-sectional view of the inner tube of the manually operated delimiter.
Figure 4:
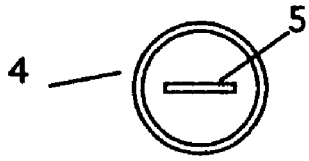
FIG. 4 is a top view of the inner tube of the manually operated delimiter.

Referring now to FIGS. 1–4, the manually operated version of my delimiter 1 is shown. The manually operated version has an outer case 2 and an inner tube 3. The inner tube 3 has a top plate 4 and a handle 5. Note that in the figures, the handle 5 is shown protruding above the plate 4, although it can be designed to be recessed in the plate as well. FIG. 1 shows the delimiter in the retracted position. This position is used during airport (or other area) maintenance when the raised delimiters would be in the way. FIG. 2 shows the parts separated. The case 2 is a hollow cylinder. Two rings of bolts 6 are placed around the top section of the case 2 as shown. These bolts act to limit the travel of the inner tube 3 as well as to keep the inner tube centered in the case. FIG. 3 is cross-sectional view of the inner tube 3 of the manually operated delimiter showing the top 4 and the handle 5. FIG. 4 is a top view of the inner tube showing the top 4 and the handle 5.

Figure 5:
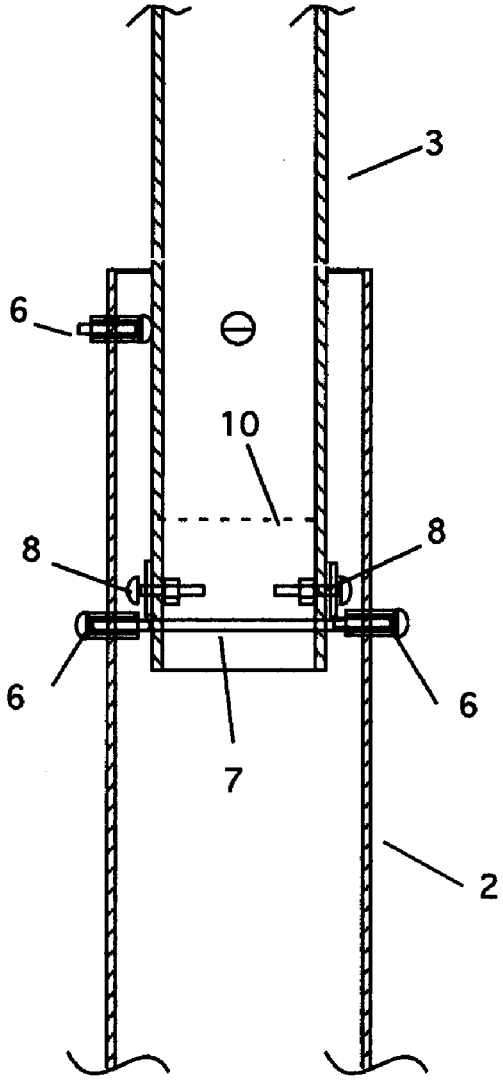
FIG. 5 is a is a detail cross-sectional view of the manually operated delimiter in the raised position showing the inner tube locked in place.
Figure 6:
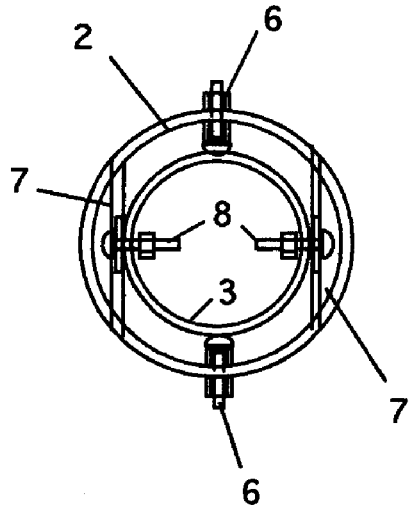
FIG. 6 is a top section view of the manually operated delimiter taken along the lines 6—6 of FIG. 5.

Referring now to FIGS. 5 and 6, details of the securing system are shown. This system is used to hold the inner tube 3 in the raised position. Two rails 7 air installed in the case 2 as shown. Two bolts 8 are installed in the bottom of the inner tube as well. Note that the term bolts here includes a bolt or screw, a nut and a washer. Of course, any other type of fixed spacer can be used as well. FIG. 6 shows a cross-section looking down into the case 2. Here, the bolts 8 are shown resting on the rails 7. In this way, the inner tube 3 is held in place and cannot drop into the case. To lower the inner tube, the use simply lifts the inner tube slightly, rotates the tube 45 degrees and lowers the inner tube into the case. The plate 4 prevents the inner tube from dropping too far into the case. By turning the inner tube 45 degrees, the bolts 8 no longer align with the rails 7 (see FIG. 6). In this way, the device can be easily lowered for maintenance. The handle 5 allows a user to use a hook to operate the device. This allows the user to remain standing or to operate the device from within a vehicle. Once lowered, the required maintenance can be performed. When completed, the inner tubes can be quickly raised and restored to operating position all along the runway or other area to be delimited. Note that in this description, the bolts and rails can be considered to be protrusions.

As mentioned above, the problem with the earlier devices is that they lack any way of shearing off at ground level if they are impacted. FIG. 5 shows a shear point 10 located about 9 inches below the surface of the ground. The shear point is a weakening of the wall of the inner tube. This can be done by scoring the inner tube, or by creating a thin spot in that area. Once created, the shear point sufficiently weakens the base of the inner tube such that if the inner tube is struck, it easily snaps off, causing no damage to the striking object.

Figures 7, 8:
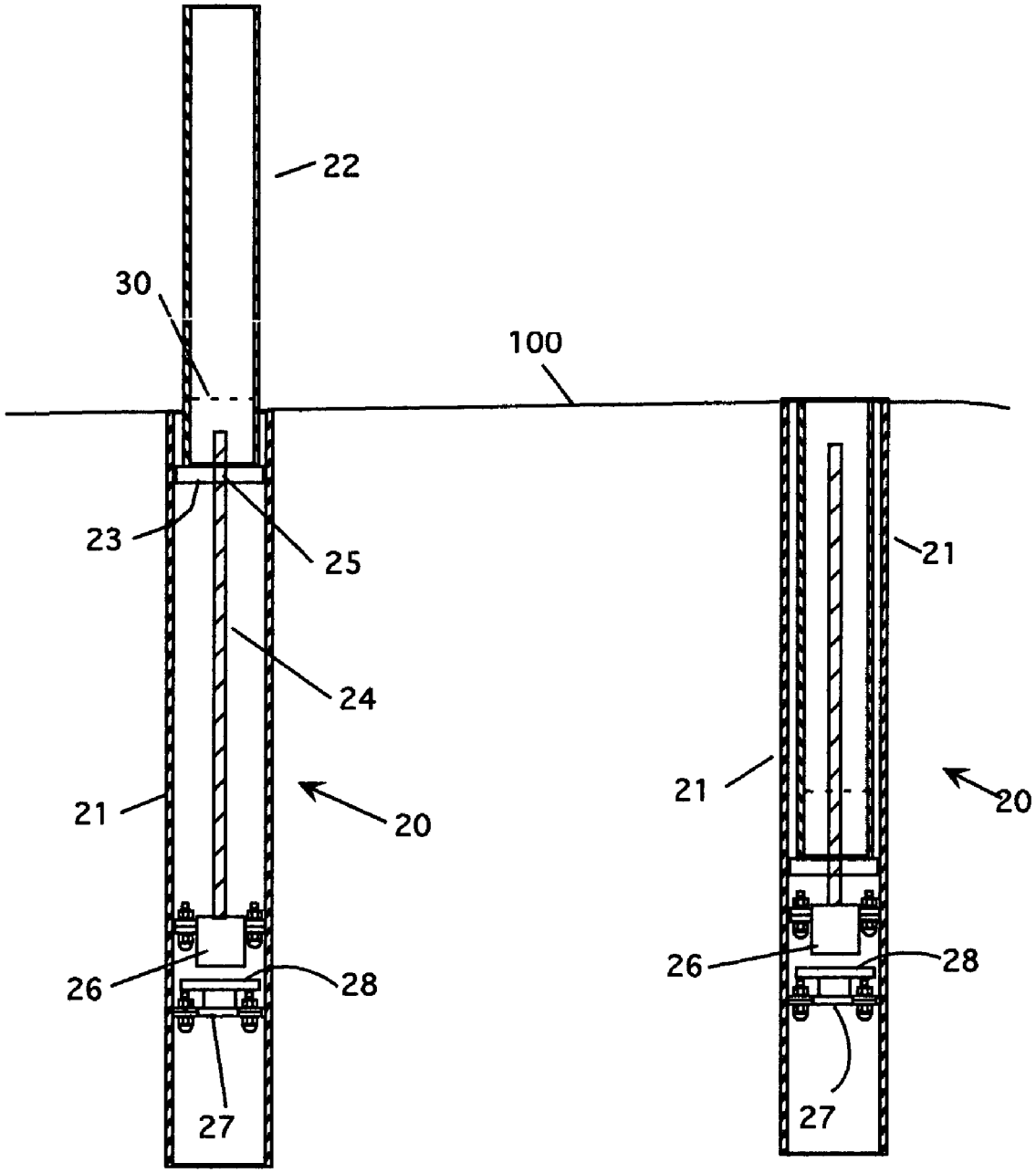
FIG. 7 is a cross-sectional view of the powered delimiter in the raised position.
FIG. 8 is a cross-sectional view of the powered delimiter in the retracted position.

Referring now to FIGS. 7 and 8, a powered version 20 of the delimiter is shown. It has an outer casing 21 that is placed below the ground surface 100. An inner tube 22 that forms the delimiter is attached to a platform 23. A worm drive 24 is attached to the bottom of the platform 23 as shown. A threaded fitting 25 is installed in the platform and the worm drive is threaded into it. A motor 26 is installed in the casing 21. The motor is secured in place to prevent it from moving. The motor is supplied by a power source 29 that feeds power through cables 27 to a control unit 28. As the motor turns, it turns the worm screw. The worm screw turns in the platform and causes the platform and thus the inner tube to be raised or lowered. Limit switches can be installed to limit the amount of travel of the worm drive so as to keep the platform within the casing. FIG. 7 shows the device in the raised position. FIG. 8 shows the device in the lowered position.

Figure 9:
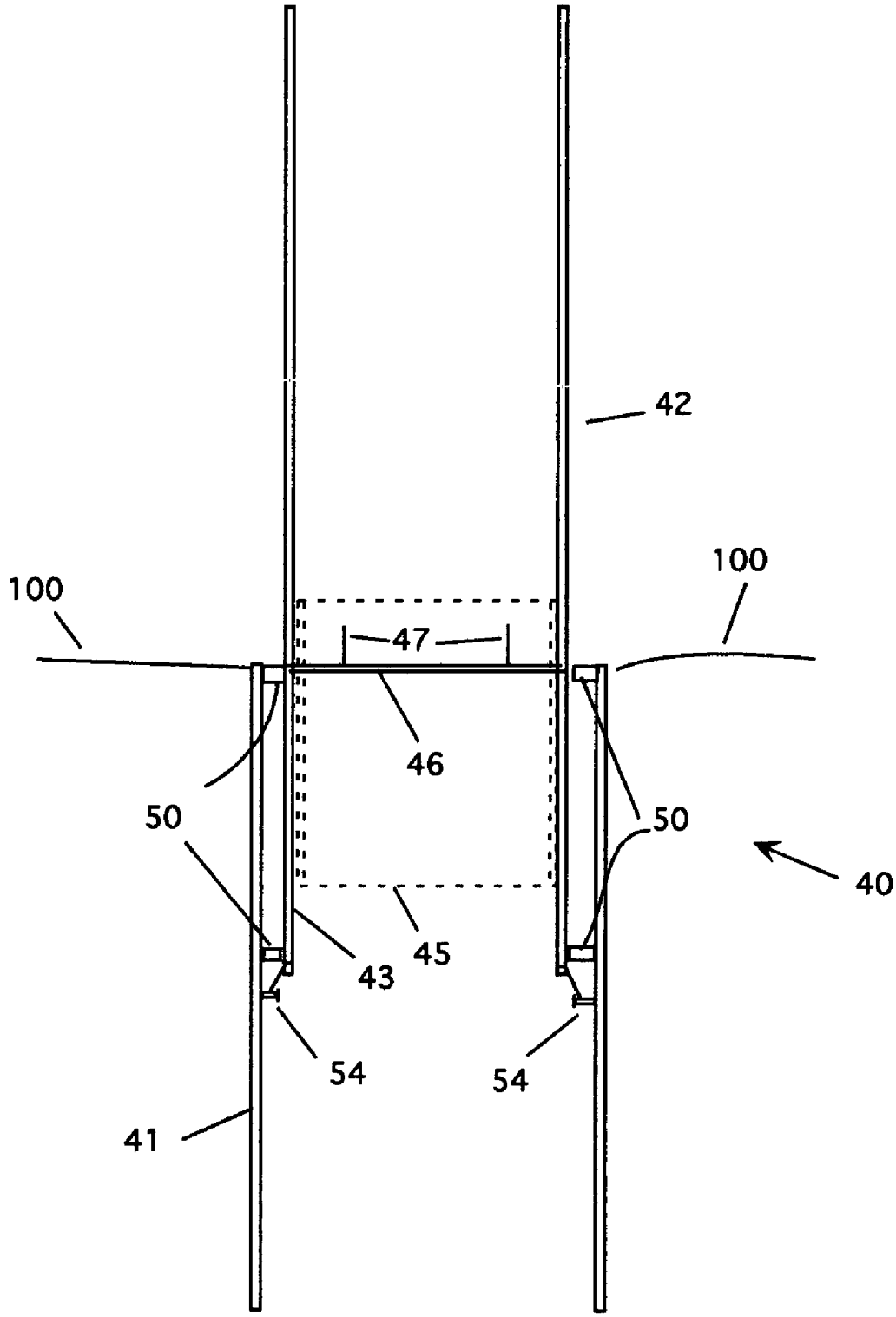
FIG. 9 is a detail view of an alternative shear mechanism.

FIG. 9 shows an alternative type shear point design. In this view, the device 40 has an outer case 41 as before, which is installed underground. The ground surface 100 is also shown in the figure. The inner post is made in two sections. The upper portion 42 forms the delimiter. A lower below ground unit 43 forms the lower part of the inner post. An inner collar 45 is placed in both the upper and lower parts of the inner post as shown. The inner collar is designed to be friction fit. As shown in the figure, there is a small gap 46 between the upper and lower posts. This gap forms the shear point. If needed, slits 47 can be cut into the upper portion as shown. Now, if the upper portion is struck lightly, it remains in place. However, if it is struck sufficiently hard, it breaks away, leaving the inner collar and the lower unit in place.

To ensure that the inner post 42 remains centered and upright in the outer case, guide rings 50 can be installed as shown. In addition to the guide rings, an upper limit system is also shown. Here, two (or more) screws 54 are secured to the lower portion of the inner post as shown. These screws contact the guide rings 50 to limit the upward movement of the inner post. The position of the screws 54 us determined by the placement of the shear point. The shear point should be places at or just above grade level. Once the proper height is determined, the screws 54 can be adjusted to ensure that the shear point is at the proper height.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A delimiter for use at airports comprising:

a) an outer case, said outer case being installed below a ground surface;

b) an inner post, positioned in said outer case such that said inner post can be raised and lowered within said outer case for use;

c) a means for raising said inner post to a raised operating position, said means of raising said inner post including a handle formed on said inner post; and d) a means for shearing said inner post from said means for raising said inner post when said inner post is struck;

e) a means for temporarily locking said inner post in said raised operating position including:

i) a first plurality of protruding members, extending outwardly from said inner post;

ii) a second plurality of protruding members, extending inwardly within said outer case;

iii) whereby said inner post is positioned in said outer case such that the first plurality of protruding members is offset from said second set of protruding members while said inner post is being raised or lowered; and iv) whereby when said inner post is in the raised operating position, said inner post is rotated until said first set of protruding members is aligned with said second set of protruding members such that the second set of protruding members blocks a downward movement of said inner post.

2. The delimiter of claim 1 wherein said means for lowering said inner post include a handle formed on said inner post.

3. The delimiter of claim 1 wherein the means for raising said inner post includes a motor.

4. The delimiter of claim 1 wherein the inner post has a top and further wherein said top of said inner post is below the ground surface when said inner post is in a lowered storage position.

5. The delimiter of claim 1 wherein the means for shearing said inner post comprises a plurality of perforations formed about said inner post.

6. The delimiter of claim 1 wherein the means for shearing said inner post are above ground when said inner post is in the raised operating position.

7. A delimiter for use at airports comprising:

a) an outer case, said outer case being installed below a ground surface;

b) an inner post, positioned in said outer case such that said inner post can be raised and lowered within said outer case for use;

c) a drive motor, installed in said outer case;

d) a drive means, operably attached to said drive motor and to said inner post such that when said drive motor rotates in a first direction, said inner post is raised and when said drive motor rotates in a second direction, said inner post is lowered; and e) a means for shearing said inner post from said drive means when said inner post is struck.

8. The delimiter of claim 7 further comprising a limit switch, wherein said limit switch is operably attached to said drive motor to limit the upward movement of said inner post.

9. The delimiter of claim 7 wherein the inner post has a top and further wherein said top of said inner post is below the ground surface when said inner post is in a lowered storage position.

10. The delimiter of claim 7 wherein the means for shearing said inner post comprise a plurality of perforations formed about said inner post.

11. The delimiter of claim 7 wherein the means for shearing said inner post are above ground when said inner post is in a raised operating position.

12. A delimiter for use at airports comprising:

a) an outer case, said outer case being installed underground;

b) an inner post, positioned in said outer case such that said inner post can be raised and lowered within said outer case for use;

c) a drive motor, fixedly installed in said outer case;

d) a base platform, attached to said inner post;

e) a worm drive shaft, operably attached to said drive motor and to said base platform; and e) a means for shearing said inner post from said base platform when said inner post is struck.

13. The delimiter of claim 12 further comprising a means for preventing said inner post from rotating within said outer case.

14. The delimiter of claim 12 further comprising a limit switch, wherein said limit switch is operably attached to said drive motor to limit the upward movement of said inner post.

15. The delimiter of claim 12 wherein the inner post has a top and further wherein said top of said inner post is below the ground surface when said inner post is in a lowered storage position.

16. The delimiter of claim 12 wherein the means for shearing said inner post comprise a plurality of perforations formed about said inner post.

17. The delimiter of claim 12 wherein the means for shearing said inner post are above ground when said inner post is in a raised operating position.

* * * * *